US010471476B2

(12) United States Patent
Enghauser et al.

(10) Patent No.: US 10,471,476 B2
(45) Date of Patent: Nov. 12, 2019

(54) METHOD AND SYSTEM FOR THE IMPROVED MANUAL PROCESSING OF UNDELIVERABLE MAIL

(71) Applicant: SIEMENS AKTIENGESELLSCHAFT, Munich (DE)

(72) Inventors: Peter Enghauser, Constance (DE); Luciano Giugno, Constance (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 15/978,240

(22) Filed: May 14, 2018

(65) Prior Publication Data

US 2019/0022704 A1 Jan. 24, 2019

Related U.S. Application Data

(60) Provisional application No. 62/535,485, filed on Jul. 21, 2017.

(51) Int. Cl.
*B07C 5/342* (2006.01)
*B07C 5/34* (2006.01)
*B07C 3/18* (2006.01)

(52) U.S. Cl.
CPC ..... *B07C 5/3422* (2013.01); *B07C 3/18* (2013.01); *B07C 5/3412* (2013.01)

(58) Field of Classification Search
CPC ..... B07C 5/3412; B07C 5/3422; B07C 3/18
USPC ..... 209/552, 583, 584, 900
See application file for complete search history.

(56) References Cited

U.S. PATENT DOCUMENTS

2006/0030969 A1* 2/2006 Norris ..... B07C 3/14 700/215
2008/0158615 A1* 7/2008 Parkos ..... B07C 3/14 358/402
2013/0299578 A1* 11/2013 Ahmed ..... B07C 5/3412 235/385
2018/0015506 A1* 1/2018 Zatopek ..... B07C 1/10

* cited by examiner

*Primary Examiner* — Terrell H Matthews
(74) *Attorney, Agent, or Firm* — Laurence Greenberg; Werner Stemer; Ralph Locher

(57) ABSTRACT

A mail sorting system and method process mail pieces that arrive at a feed point. The mail pieces are classified into machinable mail pieces and non-machinable mail pieces. The machinable mail is processed in an automated sorting machine. Mail pieces with incomplete or incorrect addressing information are classified as rejects and diverted for manual processing. A manual processing station receives the non-machinable mail pieces from the feed point and also the rejects from the automated sorting machine. In the manual processing station the mail pieces are scanned in a scanning device and the images are send to an image processing system, which also receives images from the automated sorting machine. Upon receiving the results from the automated image processing system, an operator completes labeling process from each mail piece.

6 Claims, 1 Drawing Sheet

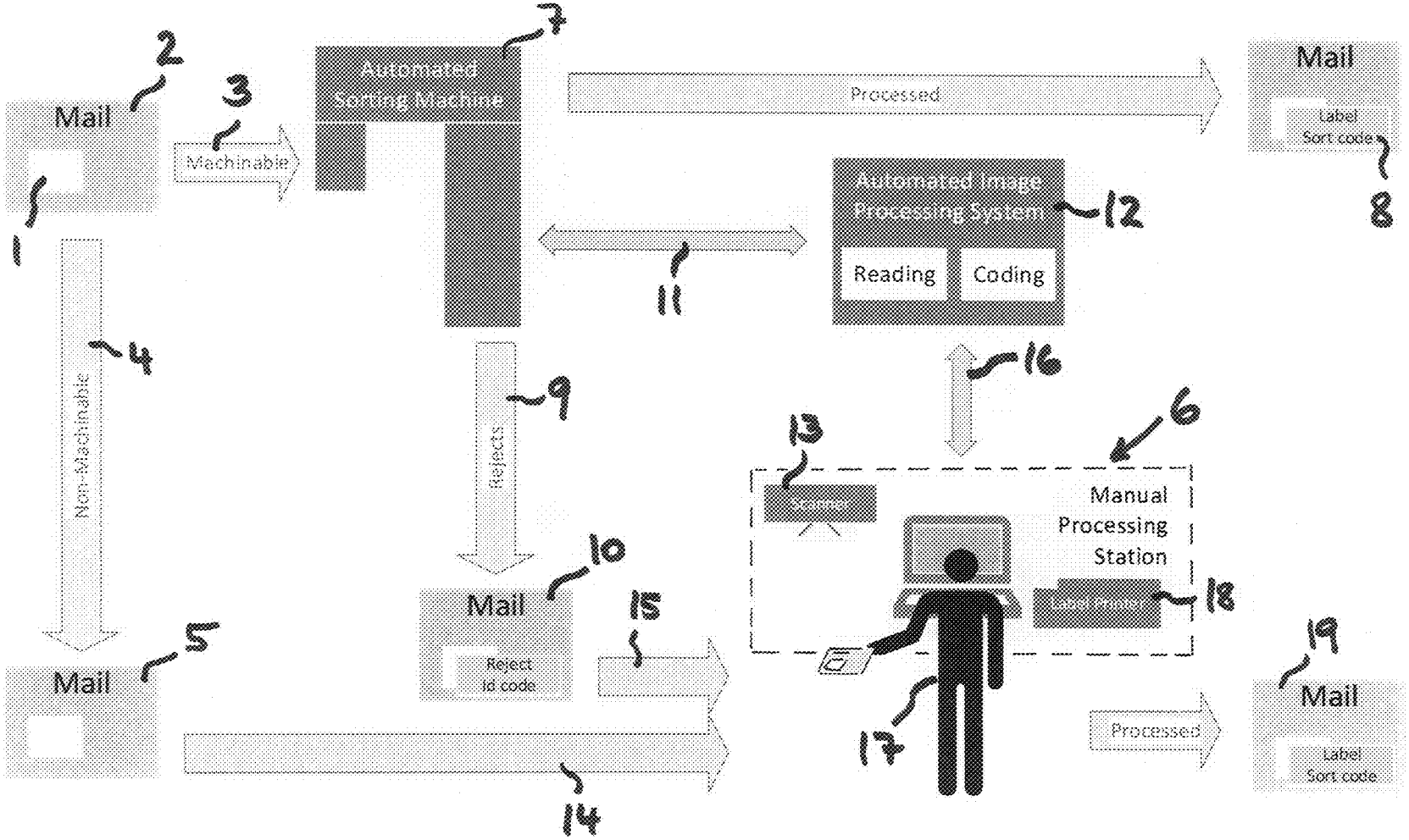
Mail
Mail
Machinable
Non-Machinable
Mail
Automated Image Processing System
Reading
Coding
Processed
Rejects
Mail
Reject id code
Manual Processing Station
Processed
Mail
Label
Sort code
Mail
Label
Sort code
1
2
3
4
5
6
7
8
9
10
11
12
13
14
15
16
17
18
19

METHOD AND SYSTEM FOR THE IMPROVED MANUAL PROCESSING OF UNDELIVERABLE MAIL

CROSS-REFERENCE TO RELATED APPLICATION

This application claims the benefit, under 35 U.S.C. § 119(e), of provisional patent application No. 62/535,485, filed Jul. 21, 2017.

BACKGROUND OF THE INVENTION

Field of the Invention

The invention pertains to mail delivery and, more specifically, to mail sorting.

Undeliverable mail, which is caused, for example when the addressee has moved, needs special processing. The mail typically receives a label before it is forwarded to a new location, returned to the sender or destroyed (i.e., wasted). This processing is typically automated using sorting machines, with integrated reading, coding and labeling capabilities. In case the automated processing fails or the mail is not machinable, the undeliverable mail needs to be processed manually.

At manual processing stations, an operator enters all necessary data directly from the undeliverable mail piece, resulting in a low throughput. The processing station generates a label, which is applied to the piece before it is sorted to several bins (e.g., forward, return, waste or reject).

BRIEF SUMMARY OF THE INVENTION

It is accordingly an object of the invention to provide a method and a system for the manual processing of undeliverable mail which overcome a variety of disadvantages that are associated with the heretofore-known systems and methods of this general type and which shall provide for faster and partially automated manual processing and better integration of the manual processing into the automated mail processing system.

With the foregoing and other objects in view there is provided, in accordance with the invention, a mail sorting system, comprising:

- a feed point for receiving a plurality of mail pieces and for classifying the mail pieces into machinable mail pieces and non-machinable mail pieces;
- an automated sorting machine for receiving the machinable mail pieces and for sorting the mail pieces, wherein mail pieces with incomplete or incorrect addressing information are classified as rejects and diverted for manual processing;
- an image processing system connected to receive from the automated sorting machine images obtained of the mail pieces;
- a manual processing station configured to receive selected mail pieces, namely, the non-machinable mail pieces from the feed point and the rejects from the automated sorting machine;
- the manual processing station having a scanning device for acquiring an image of each of the selected mail pieces received by the manual processing station, and a data connection for transmitting images acquired by the scanning device to the image processing system.

In accordance with an added feature of the invention, the manual processing station includes a label writer for generating a label for respective mail pieces after processing in the manual processing station.

In other words, the novel invention allows the manual processing of undeliverable mail to become semi-automated using a scanning device, allowing the integration into the existing, fully automated process.

For the purpose of this specification, the term "manual processing" shall refer to a hybrid process in which machine automation is utilized as far as possible and the semi-automated process is supported by literally manual processing. In other words, the term "manual processing" shall refer to the diversion of mail pieces away from the fully automated process.

The terms "mail pieces" or "mail" refers to all types of mail, namely, flat mail pieces, from postcards to stuffed letter envelopes, to flat boxes, full volume boxes, or soft packages and the like.

The term "machinable mail" refers to the fact that the mail piece contains or carries identification that allows the system to automatically process the same. Non-machinable mail is forwarded for manual processing. Machinable mail is forwarded to the automated sorting machine. From there, the mail pieces are either processed for sorting and distribution or they are classified as rejects and forwarded for manual processing.

In the fully automated process, images of the mail pieces are taken and forwarded to archiving/tracing/diagnostic systems. In contrast with the prior art manual processing, such images are now also taken of the non-machinable mail pieces and used in the manual process.

With the above and other objects in view there is also provided, in accordance with the invention, a mail sorting method, comprising:

- receiving mail pieces at a feed point of a mail sorting system;
- classifying the mail pieces into machinable mail pieces and non-machinable mail pieces;
- forwarding the machinable mail pieces to an automated sorting machine and sorting the mail pieces according to address information carried by the mail pieces, wherein mail pieces with incomplete or incorrect addressing information are classified as rejects;
- acquiring images of the mail pieces classified as rejects and storing the images in an image processing system;
- forwarding the non-machinable mail pieces and the mail pieces classified as rejects to a manual processing station;
- scanning the mail pieces received in the manual processing station and acquiring an image of each of the mail pieces or the address information carried by the mail pieces;
- transmitting the images acquired by the scanning device from the manual processing station to an image processing system; and
- manually processing the mail pieces by an operator on the basis of a result received from the image processing system, and labeling and forwarding the mail pieces for delivery, for return to sender, or for wasting.

The following advantages are obtained by the novel system and method:

- The manual processing becomes semi-automated, based on image processing including reading and video coding technologies of automated processing. Previously failed automated processing can be continued at the manual processing station, using the re-identification of the processing based on the label barcode.

Throughput of manual processing increases significantly, because unresolved data only needs to be completed instead of entering all data from scratch.

All mail pieces that are processed are available in the archive/tracing/diagnostic systems and they have an image of the piece that has been processed.

All pieces that are processed benefit from automated image processing (e.g. consider barcode data).

Because manual processing is integrated into the automated system, only a single system needs to be maintained.

Non-machinable mail can be handled like machinable mail, i.e. work flows are harmonized.

According to an advantageous embodiment, depending on the processing delay at automated processing, the system provides for batch processing, which raises the handling efficiency. In other words, instead of scanning a single piece, waiting for the result from the automated processing system before completing manual processing, the operator might scan a batch of pieces, e.g. a few hundred. During a later labeling process, the operator finishes processing the entire batch by stepping through the batch pieces once more, seeing the image and results from automated processing. The operator corrects/completes the results as needed, generates and applies the label before moving to the next piece of the batch.

The described approach to integrated manual processing for mail pieces into automated processing can also be applied for forms processing, e.g. to create change of address records, needed to process undeliverable mail.

Other features which are considered as characteristic for the invention are set forth in the appended claims.

Although the invention is illustrated and described herein as embodied in a method and a system for the manual processing of undeliverable mail, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWING

The sole FIGURE of the drawing is a schematic diagram illustrating the semi-automated processing of undeliverable mail.

DESCRIPTION OF AN EXEMPLARY EMBODIMENT OF THE INVENTION

Referring now to the FIGURE of the drawing in detail, mail pieces 1 are input at a feed point 2 and scanned. The scanning process classifies the mail pieces 1 as being machinable 3 or non-machinable 4. Non-machinable mail 5 is diverted directly to a manual processing station 6. Machinable mail pieces 1 are forwarded to a fully automated process in which the mail pieces 1 are sorted in an automated sorting machine 7. Those mail pieces 1 that have a proper address label that can be deciphered by the sorting machine 7 are processed and provided with a sort code label 8 for delivery into distribution bins.

Mail pieces 1 which fail automated processing by the sorting machine 7 are rejected, categorized as rejects 9, provided with a label carrying a special ID code 10, such as a barcode, which allows later identification in manual handling.

In addition, the automated processing system preserves a related image and partial reading and coding results. These data are forwarded 11 and stored in an automated image processing system 12.

The manual processing station 6 thus has two input streams, namely, an input stream 14 of non-machinable mail 5 and an input stream 15 of machinable, but not fully sortable mail (i.e., rejected, machinable mail).

The novel manual processing station 6 is provided with a scanning device 13, or scanner.

There the operator scans non-machinable mail pieces arriving at the input 14 or rejected mail pieces arriving at the input 15 from the automated processing. A scanned image is sent 16 to the automated image processing system 12. The latter checks for a label allowing identification and either looks up a previously processed image and partial results or processes the new image acquired by the scanner 13.

In both cases, the image and automated processing results are returned to the manual processing station and presented to an operator 17 at the manual processing station 6. There, the operator 17 completes the processing of the respective mail piece. The operator 17 views the image and the results from the automated processing, upon which the operator corrects/completes the results as needed, then generates a label. The manual processing station creates the label with a label printer 18; the label is applied to the mail piece and then sorted for delivery into respective delivery bins 19 (e.g., delivery, mail forwarding, return to sender, waisting).

Finally, the automated processing system can send the processing results together with the image to archive/tracing/diagnostic systems.

The following is a summary list of reference numerals and the corresponding structure used in the above description of the invention:

1 mail piece(s)
2 feed point
3 machinable classification
4 non-machinable classification
5 non-machinable mail
6 manual processing station
7 automated sorting machine
8 sort code label
9 rejects
10 ID code
11 image forward
12 image processing system
13 scanning device
14 input (non-machinable)
15 input (rejects, machinable)
16 scan image forward
17 manual processing station operator
18 label printer
19 processed mail delivery

The invention claimed is:

1. A mail sorting system, comprising:

a feed point for receiving a plurality of mail pieces and for classifying the mail pieces into machinable mail pieces and non-machinable mail pieces;

an automated sorting machine for receiving the machinable mail pieces and for sorting the mail pieces, wherein mail pieces with incomplete or incorrect addressing information are classified as rejects and diverted for manual processing;

an image processing system connected to receive from said automated sorting machine images obtained of the mail pieces;

a manual processing station configured to receive selected mail pieces, namely, the non-machinable mail pieces from said feed point and the rejects from said automated sorting machine;

said manual processing station having a scanning device for acquiring an image of each of the selected mail pieces received by said manual processing station, and a data connection for transmitting images acquired by said scanning device to said image processing system.

2. The mail sorting system according to claim 1, wherein said manual processing station includes a label writer for generating a label for respective mail pieces after processing in said manual processing station.

3. A mail sorting method, comprising:

receiving mail pieces at a feed point of a mail sorting system;

classifying the mail pieces into machinable mail pieces and non-machinable mail pieces;

forwarding the machinable mail pieces to an automated sorting machine and sorting the mail pieces according to address information carried by the mail pieces, wherein mail pieces with incomplete or incorrect addressing information are classified as rejects by the automated sorting machine;

acquiring images of the mail pieces classified as rejects and storing the images in an image processing system;

forwarding the non-machinable mail pieces and the mail pieces classified as rejects to a manual processing station;

scanning the mail pieces received in the manual processing station and acquiring an image of each of the mail pieces or the address information carried by the mail pieces;

transmitting the images acquired by the scanning device from the manual processing station to an image processing system; and manually processing the mail pieces by an operator on the basis of a result received from the image processing system, and labeling and forwarding the mail pieces for delivery, for return to sender, or for wasting.

4. The method according to claim 3, which comprises subjecting the mail pieces to batch processing, which includes:

scanning a batch of a multiplicity of mail pieces and forwarding the images thus acquired to the image processing system;

during a subsequent labeling process, stepping through the mail pieces of the batch once more, including viewing the image and results received from automated processing by the image processing system; and completing or correcting the results, as needed, and labeling a respective mail piece before moving to a next mail piece of the batch.

5. The method according to claim 3, which comprises, in the labeling process, labeling the mail pieces based on input from the image processing system and manual input from the operator.

6. The mail sorting system according to claim 2, wherein said label writer is configured for generating the label for respective mail pieces based on input from said image processing system and input from an operator at said manual processing station.

* * * * *